US006264028B1

(12) United States Patent
Wu

(10) Patent No.: US 6,264,028 B1
(45) Date of Patent: Jul. 24, 2001

(54) GOLF BAG CAPABLE OF RAISING GOLF CLUBS

(75) Inventor: Fang-Li Wu, Tainan Hsien (TW)

(73) Assignee: Sports World Enterprise Co., Ltd., Tainan Hsien (TW)

( * ) Notice: Subject to any disclaimer, the term of this patent is extended or adjusted under 35 U.S.C. 154(b) by 0 days.

(21) Appl. No.: 09/474,251

(22) Filed: Dec. 29, 1999

(51) Int. Cl.[7] ..... A63B 55/00

(52) U.S. Cl. ..... 206/315.3; 206/315.3; 206/315.6; 248/96

(58) Field of Search ..... 206/315.6, 315.3; 298/96

(56) References Cited

U.S. PATENT DOCUMENTS 5,540,431 * 7/1996 Crozier ..... 206/315.3
5,799,786 * 9/1998 Beck et al. ..... 206/315.7
5,901,845 * 5/1999 Cheng ..... 206/315.7
6,010,101 * 1/2000 Stein et al. ..... 206/315.7 X

* cited by examiner

*Primary Examiner*—Allan W. Shoap
*Assistant Examiner*—Tri M. Mai
(74) *Attorney, Agent, or Firm*—Rosenberg, Klein & Lee

(57) ABSTRACT

A golf bag capable of raising golf clubs received therein is provided. The golf bag has a bottom part having a front flat portion and a rear slope portion. The rear slope portion has two holding tubes projecting into said golf bag. The holding tubes each has a sliding member movably received therein. The sliding members each has a raising block passed through a lengthwise arranged guide slot of a respective one of the holding tubes. The sliding members have lower ends contacting a first raising plate pivoted on the bottom part. A second raising plate is movably received in the golf bag with a bottom resting on the raising blocks of the sliding members. The second raising plate has holes for the holding tubes to be passed therethrough. When the golf bag is supported on the ground in a sloping position with the rear slope portion of the bottom part resting on the first resting plate, the first raising plate will force the sliding members to move upwards. Consequently, the second raising plate and the golf clubs disposed on the second raising plate are raised.

1 Claim, 9 Drawing Sheets

GOLF BAG CAPABLE OF RAISING GOLF CLUBS

BACKGROUND OF THE INVENTION

The present invention relates to a golf bag and particularly to one which can move the golf clubs held therein to a higher position when the golf bag is propped against a support leg member thereof. The user of the golf bag can pick the desired one of the golf clubs more easily after same have been raised.

Referring to FIG. 9, a heretofore known golf bag comprises a main body 10, a support leg member 30, a first bottom plate 20, a second bottom plate 40 and a connecting rod 50.

The main body 10 is substantially cylindrical, and has a top opening provided for golf clubs to be put into or taken from the same. The main body 10 has a bottom, of which a rear part is a slope.

The first bottom plate 20 is pivoted on the bottom of the main body 1.

The second bottom plate 40 is arranged inside the main body 10, and connected to an inner support member 60. The connecting rod 50 is pivoted to the first and the second bottom plates 20,40 from two ends thereof respectively.

The support leg member 30 has two support legs 301, and is coupled to the straight side of the main body.

Thus, when the golf bag is propped against the support legs 301, the bottom slope will rest on the ground, making the first bottom plate 20 pivot upwards, and forcing the second bottom plate 40 to pivot upwards. Consequently the inner support member 60 is raised and the golf clubs resting thereon are also moved to a higher position.

SUMMARY OF THE INVENTION

It is a main object of the present invention to provide a golf bag capable of raising golf clubs therein, which can be used more easily.

The golf bag comprises:

a holding part provided for holding golf clubs;

a bottom part connected to a lower end of the holding part; the bottom has a front flat portion and a rear slope portion; the bottom part has two holding tubes projecting into the holding part; the holding tubes each has a guide slot lengthwise arranged thereon;

two sliding members each movably received in a respective one of the holding tubes; the sliding members each has a raising block passed through the guide slots of the holding tubes; the bottom part has elongated openings thereon for permitting the raising blocks of the sliding members to move therethrough;

a first raising plate pivoted to a lower side of the bottom part; the first raising plate having an upper side contacts lower ends of the sliding members;

a second raising plate movably received in the holding part, disposed on an upper side of the bottom part; the second raising plate has holes for permitting the holding tubes of the bottom part to be passed therethrough, and has a lower side resting on the raising block of the sliding members; the second raising plate has guide protrusions fitted onto guide trenches parallel to the holding tubes for guiding a movement thereof;

whereby the golf clubs are capable of being raised by disposing the golf bag in a sloping position where the rear slope part of the bottom part rests on the first raising plate with the first raising plate forcing the sliding members to move upwards to raise the second raising plate and golf clubs disposed thereon.

BRIEF DESCRIPTION OF THE DRAWINGS

The present invention will be better understood by reference to the accompanying drawings, wherein.

DESCRIPTION OF THE PREFERRED EMBODIMENTS

Figure 1:
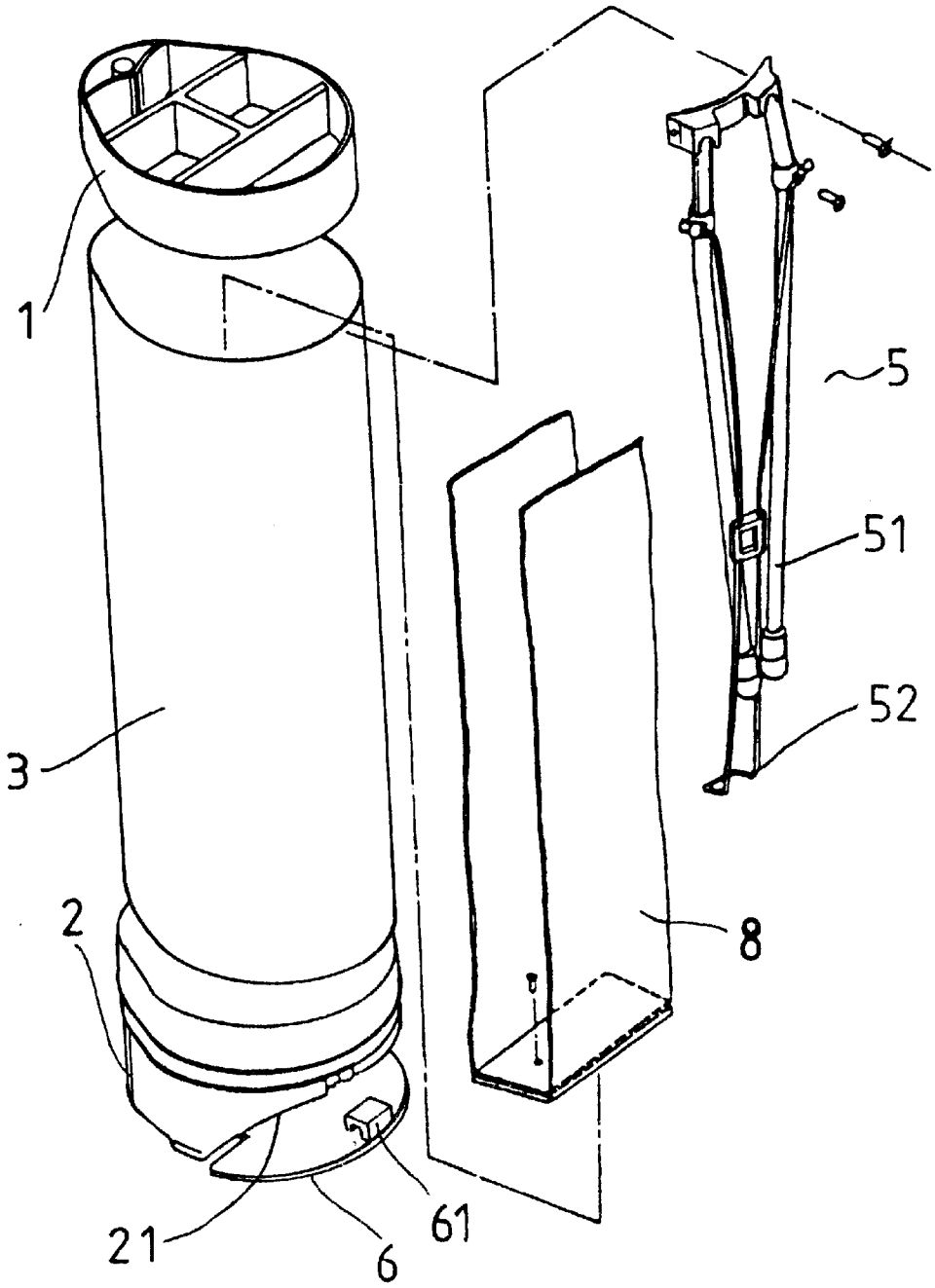
FIG. 1 is an exploded perspective view of the golf bag capable of raising the golf clubs according to the present invention.
Figure 2:
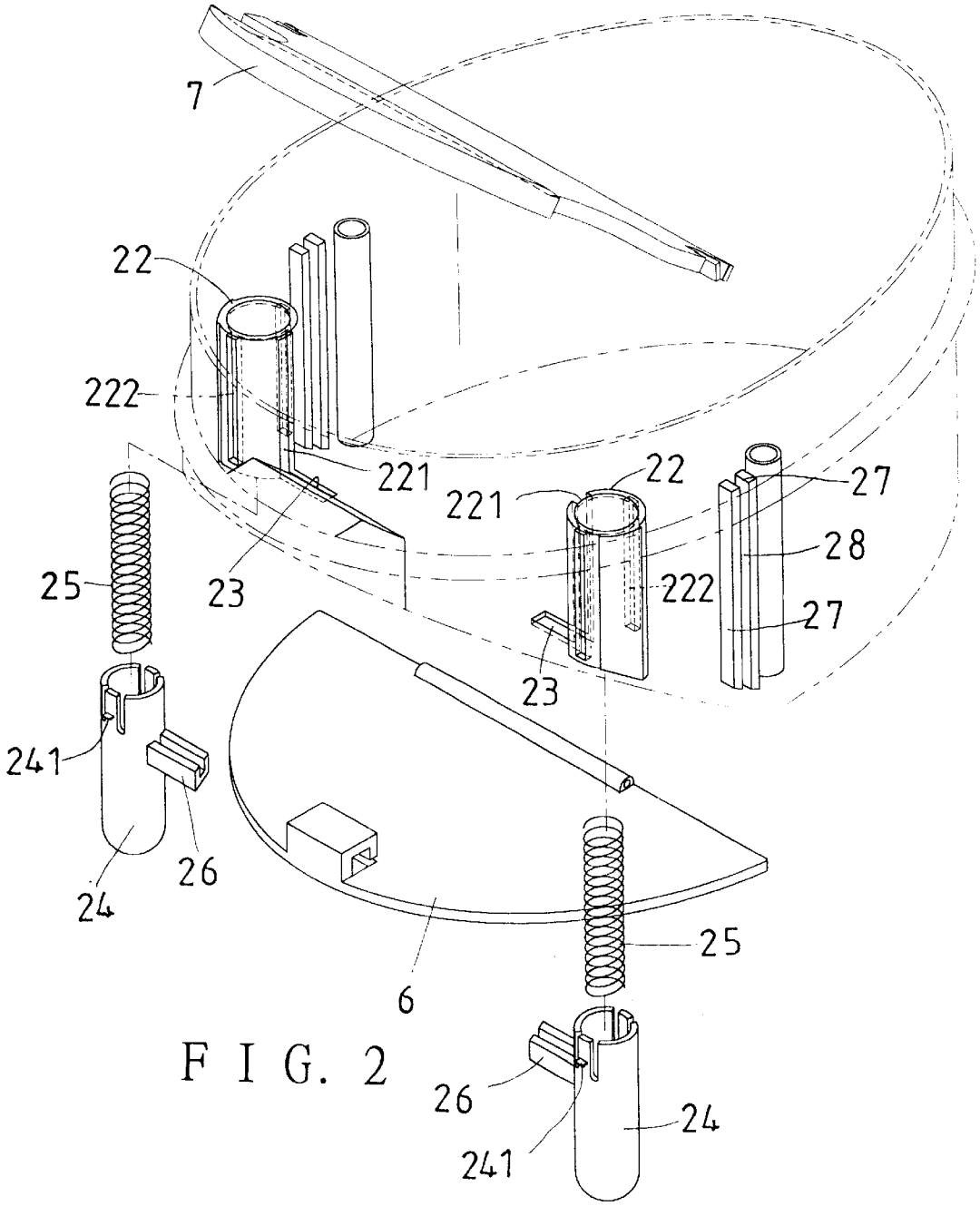
FIG. 2 is a fragmentary exploded perspective view of the golf bag capable of raising the golf clubs according to the present invention.

Referring to FIGS. 1 and 2, a golf bag of the present invention comprises an upper compartment member 1, a bottom part 2, a holding part 3, a support leg assembly 5, a first raising plate 6, a second raising plate 7 and an inner support part 8.

The holding part 3 is cylindrical, provided for holding golf club 4 therein. The upper compartment member 1 is connected to the upper end of the holding part 3. The bottom part 2 is connected to the lower end of the holding part 3. The inner support part 8 is movably received in the holding part 3; the golf clubs held in the holding part 3 rest on the inner support part 8.

The support leg assembly 5 is fitted to the holding part 3, and has two support legs 51 and a connecting rod 52. The support legs 51 are pivoted and connected to the upper end of the connecting rod 52 such that same can be pivoted outwards when the connecting rod 52 is moved upwards.

The bottom part 2 has a front flat part (not numbered) and a rear slope part 21. The first raising plate 6 is pivoted to the bottom part 2 under the slope part 21. The first raising plate 6 has an outer end connecting element 61 connecting a lower end of the connecting rod 52 of the support leg assembly 5.

Referring specifically to FIG. 2, the bottom part 2 has two holding tubes 22 projecting into the holding part 2, each having an open lower end. The holding tubes 22 each has two opposing straight trenches 222 and a lengthwise arranged guide slot 221. The bottom part 2 has two elongated openings 23 each communicating with a respective one of the guide slots 221. Two sliding members 24 are provided, each having two protrusions 241 and a raising block 26. The sliding member 24 are each received in a respective one of the holding tube 22 with the protrusions 241 received in the straight trenches 222, and with the raising blocks 26 passed through the guide slots 221. Elastic members 25 are located between the holding tubes 22 and the sliding members 24 in order to bias the sliding members downwardly to a proper position. When the sliding members 24 are moved downwards, the raising blocks 26 can pass through the elongated openings 23 of the bottom part 2. Thus, the sliding members 24 can slide up and down inside the holding tubes 22.

The lower ends of the sliding members 24 contact the upper side of the first raising plate 6.

The bottom part 2 further has two pairs of guide bars 27 thereon, arranged near a respective one of the holding tubes 22. Each pair of guide bars 27 form a guide trench 28 therebetween.

Figure 3:
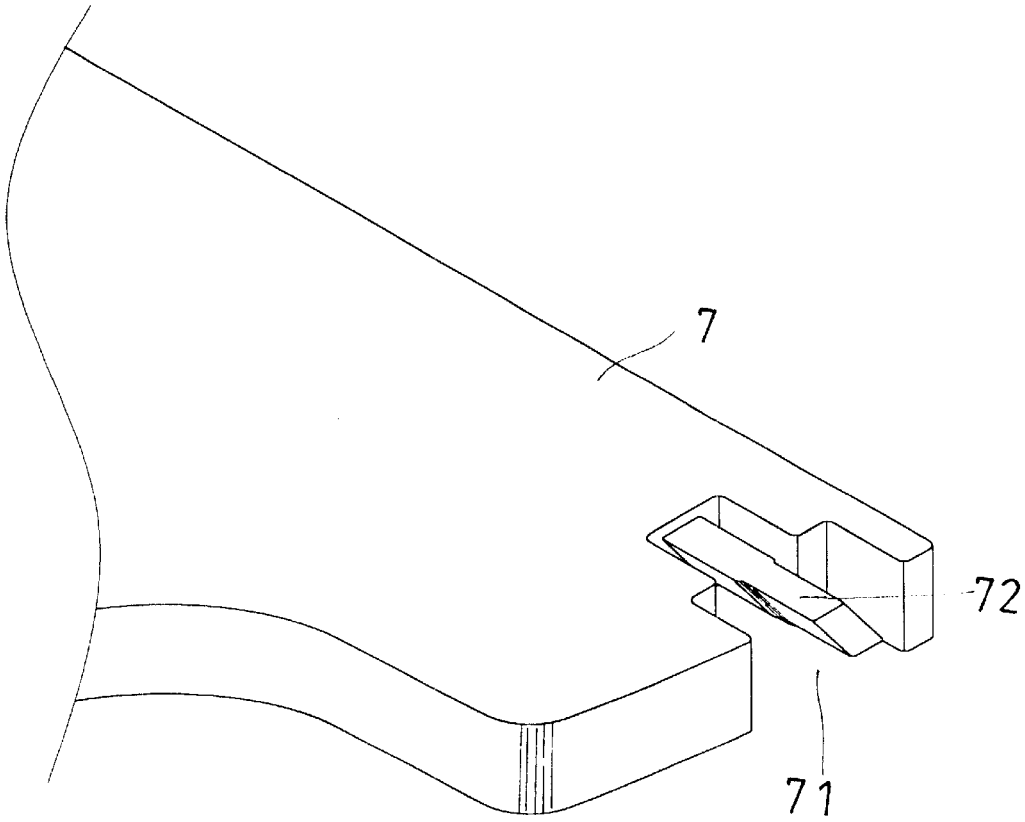
FIG. 3 is a perspective view of a part of the second raising plate according to the present invention.

The second raising plate 7 is movably arranged above the bottom part 2 and under the inner support part 8, and has two holes (not numbered) provided for the holding tubes 22 to be passed through. Referring to FIG. 3, the second raising plate 7 further has two gaps 71 each having a guide protrusion 72 therein; the guide protrusions 72 are each received in a respective one of the guide trenches 28 such that the movement of the second raising plate 7 is confined by the guide trenches 28. The bottom of the second raising plate 7 contacts the raising blocks 26 of the sliding members 24.

Figure 4:
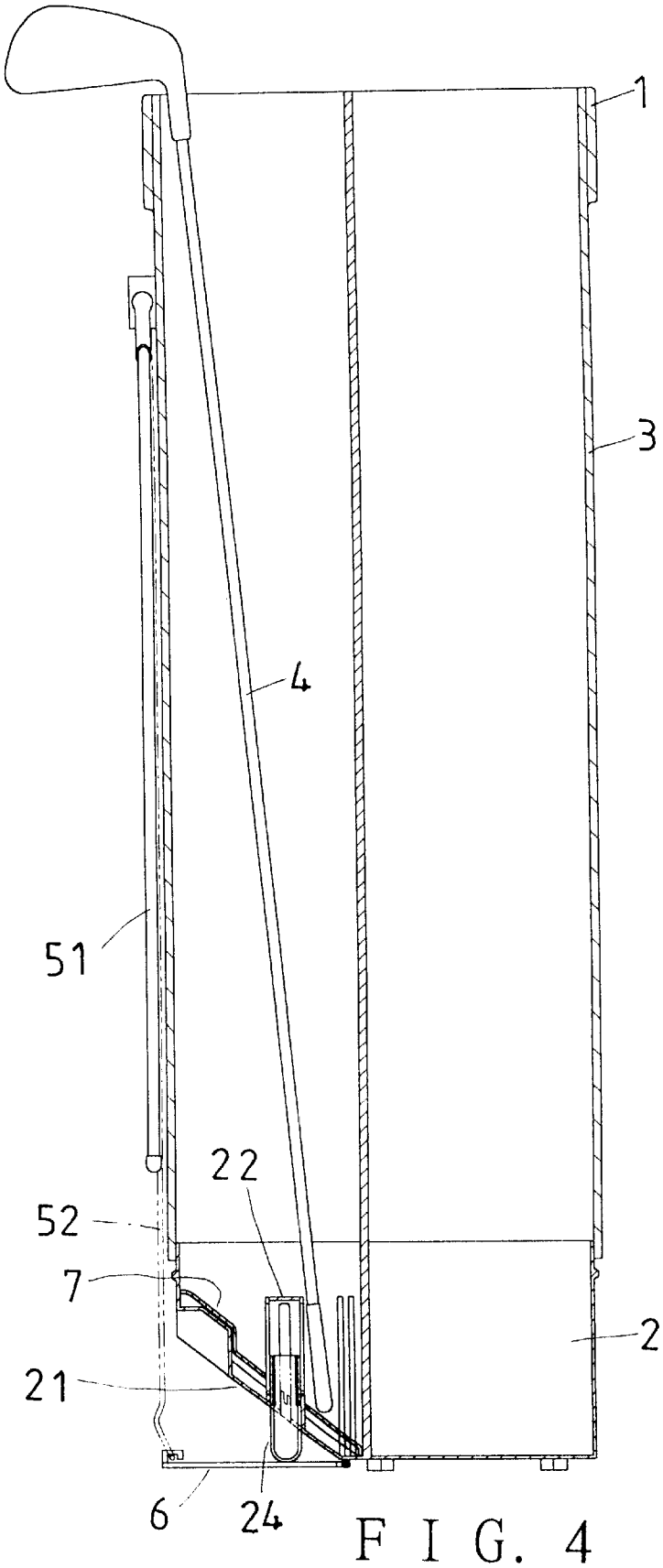
FIG. 4 is a side view of the golf bag according to the present invention.
Figure 5:
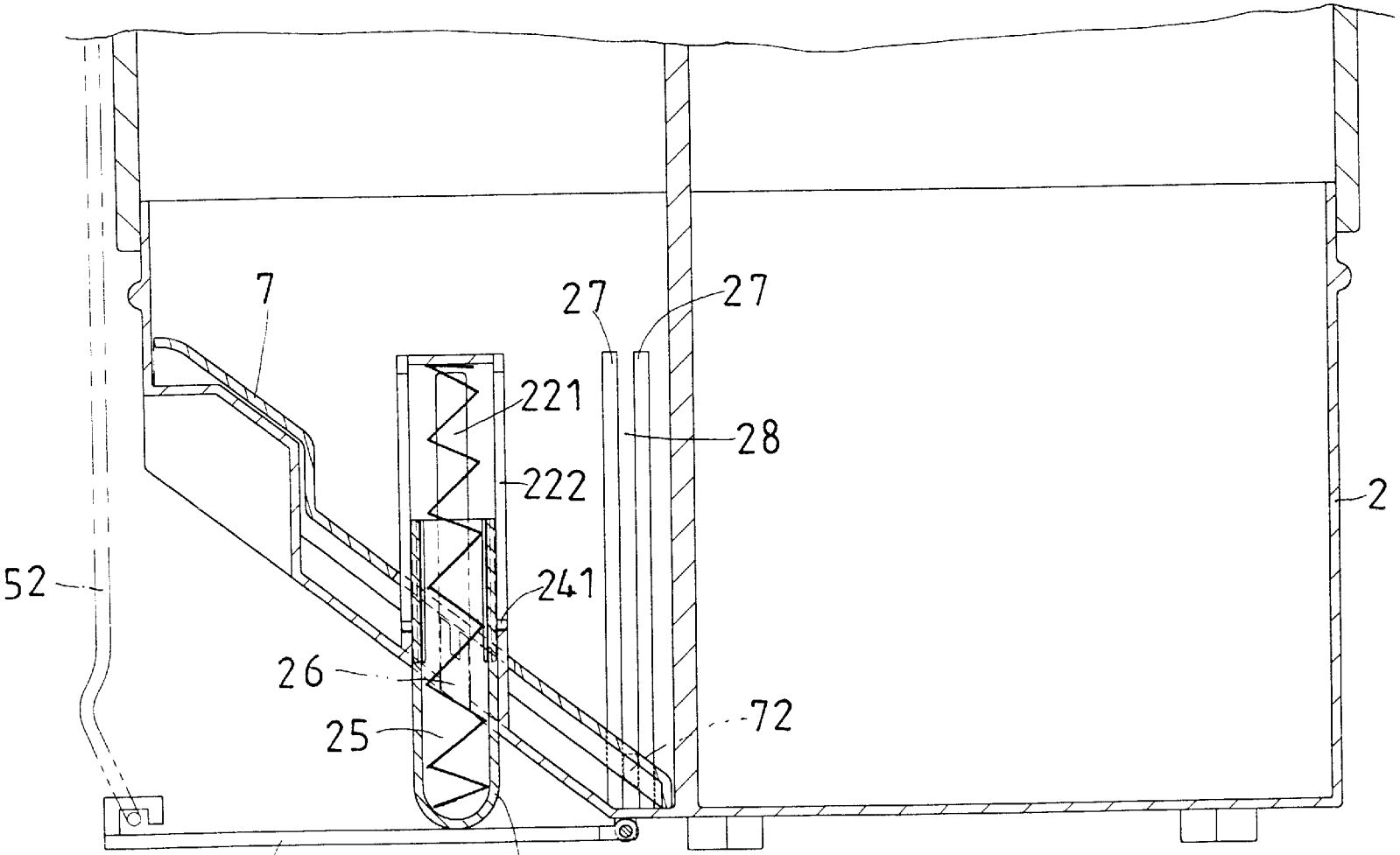
FIG. 5 is a side view of the lower part of the golf bag according to the present invention.
Figure 6:
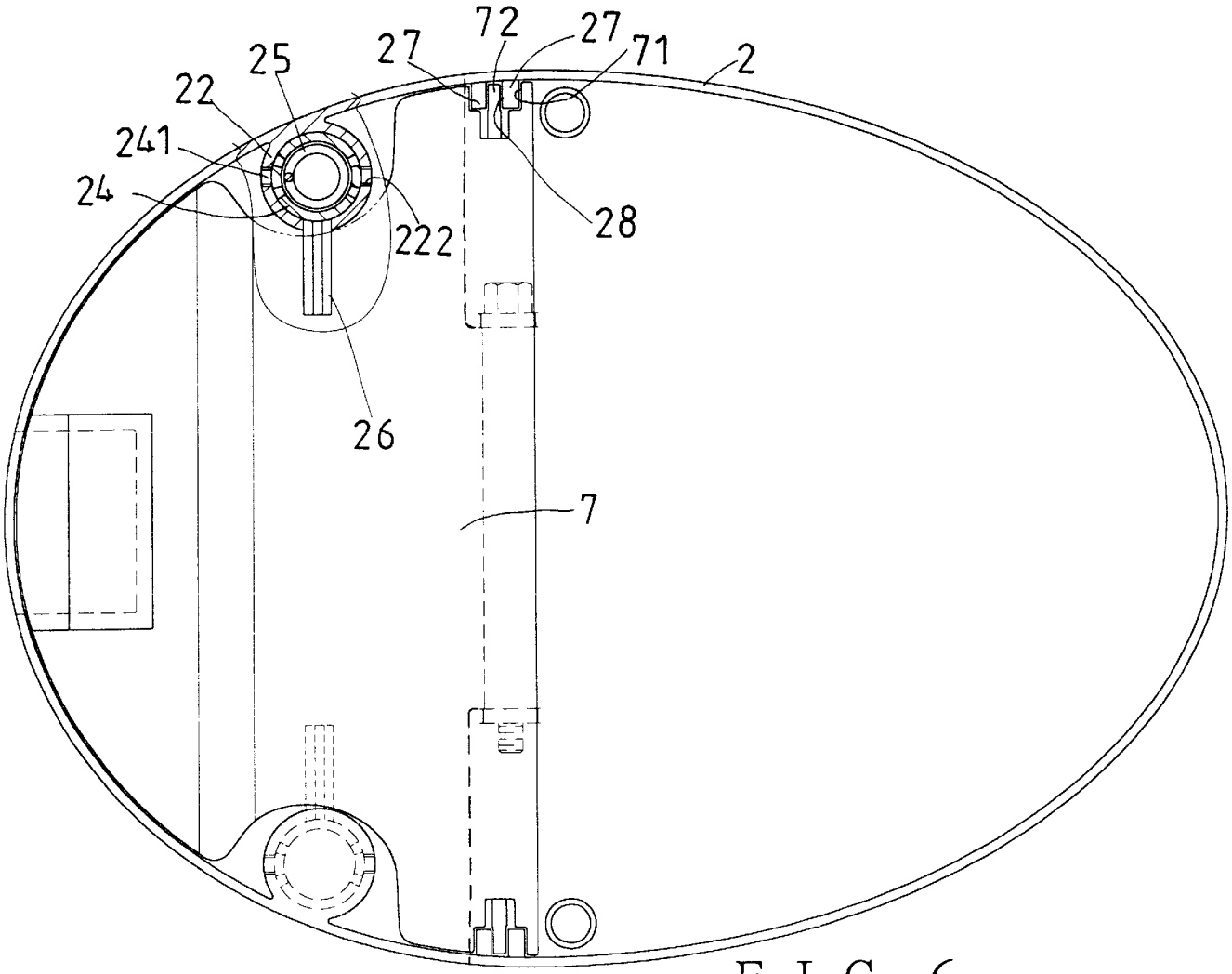
FIG. 6 is a top view of the golf bag according to the present invention.
Figure 7:
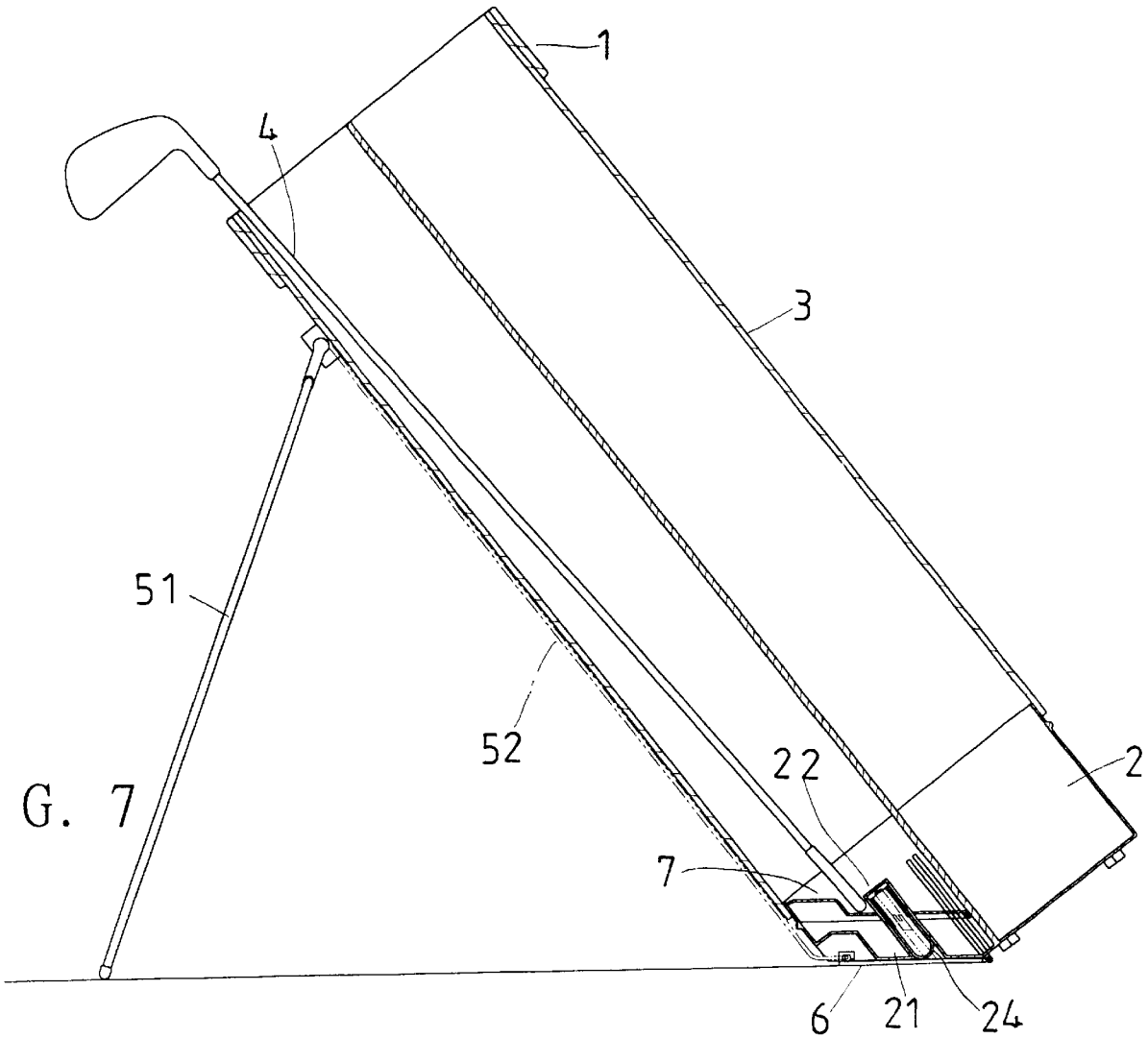
FIG. 7 is a side view of the golf bag of the present invention, propped in a sloping position against the support legs.
Figure 8:
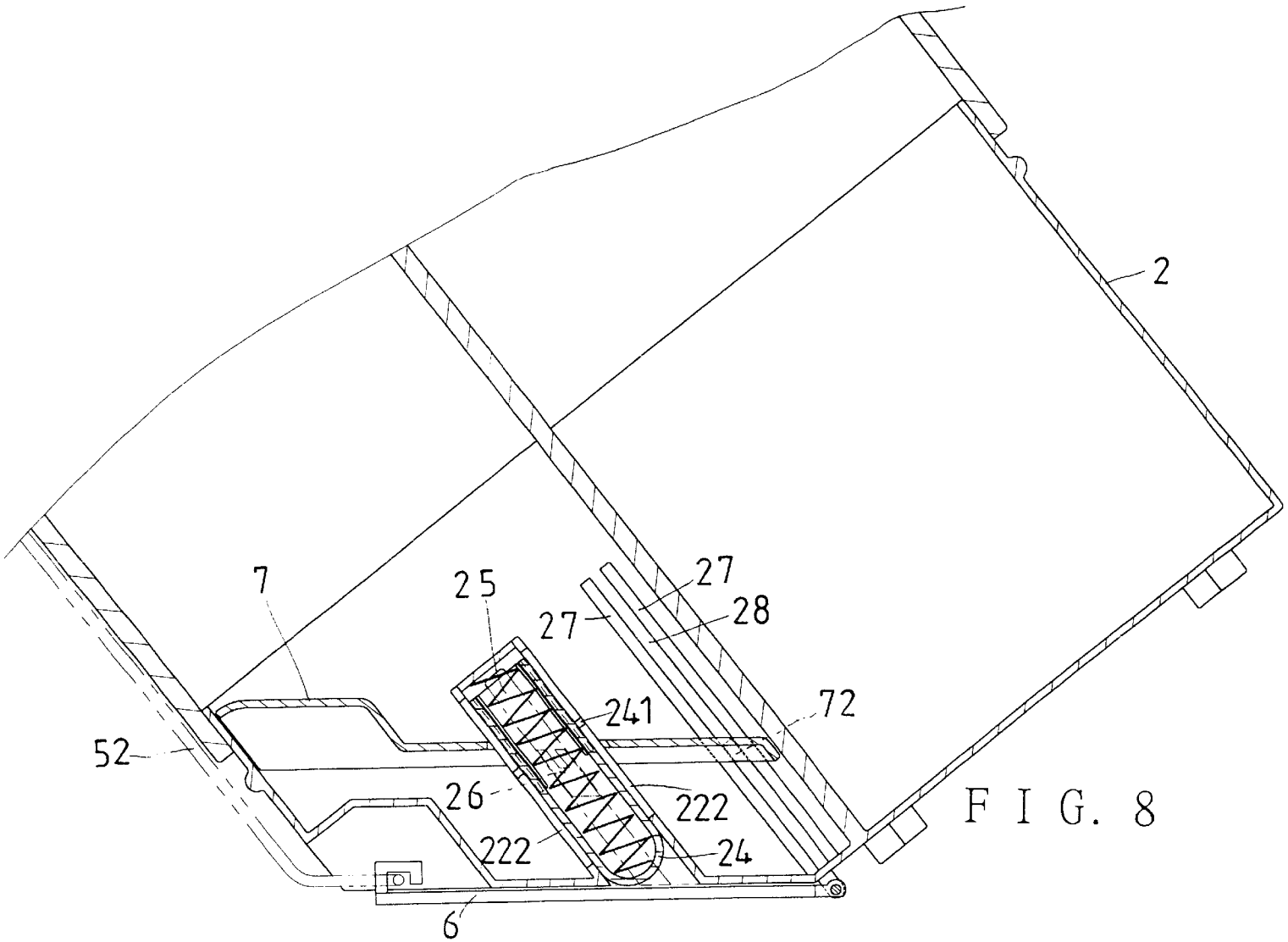
FIG. 8 is a side view of the lower part of the golf bag in FIG. 7.
Figure 9:
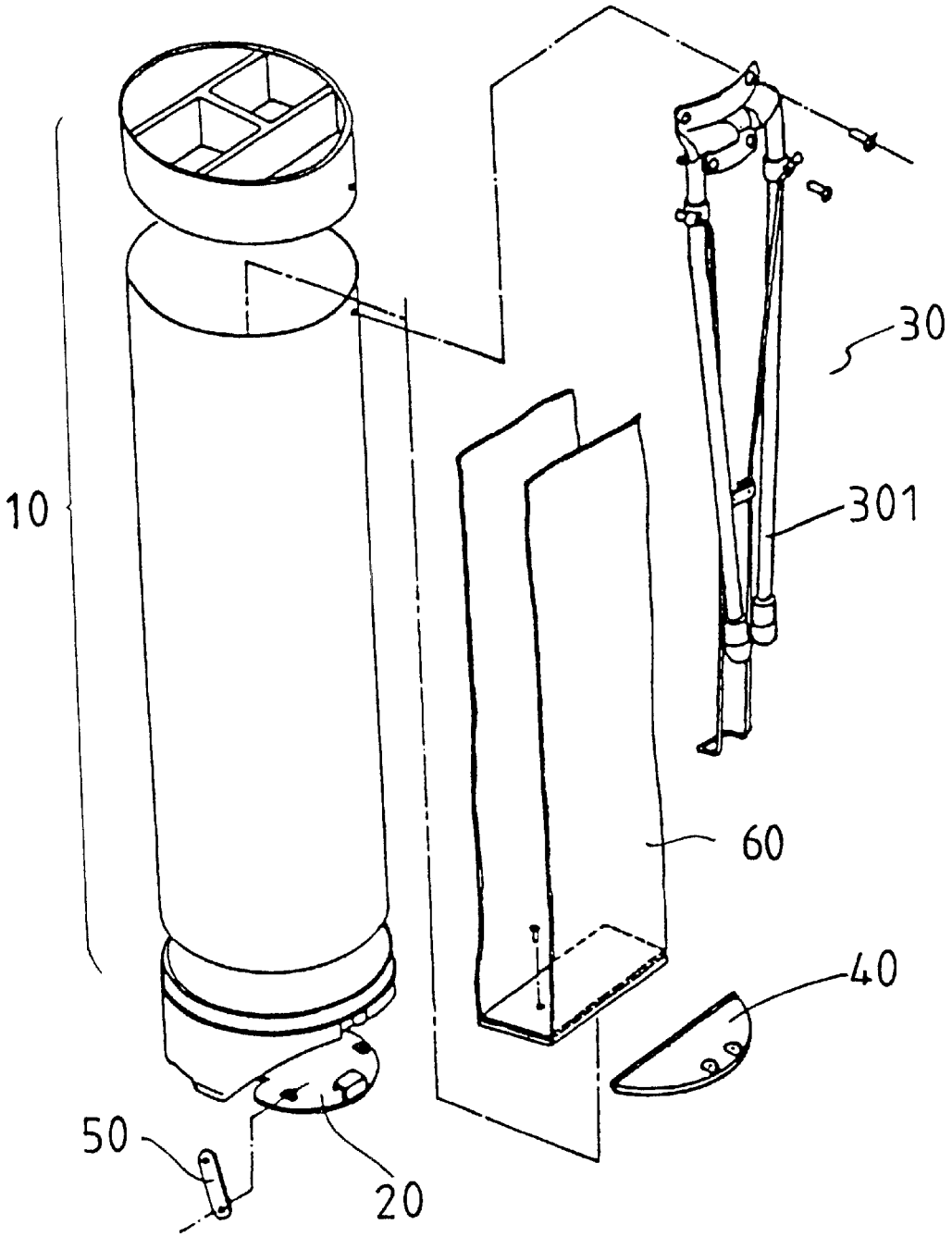
F I G. 9 (PRIOR ART)
FIG. 9 is an exploded view of the prior art golf bag as described in the Background.

Thus, when the golf bag is lifted by the user or stands upright on the ground, the first raising plate 6 will be located in a first position where same is parallel to the front flat part of the bottom part 2, as shown in FIG. 4. When the golf bag is supported in a sloping position with the rear slope part 21 of the bottom part 2 resting on the first resting plate 6; the connecting rod 52 will force the support legs 51 to pivot outwards to support the golf bag, and the first raising plate 6 will force the sliding members 24 to move upwards. Thus, the raising blocks 26 of the sliding members 24 raise the second raising plate 7. Consequently, the inner support part 8, and the golf clubs resting on the inner support part 8 are moved upwards, as shown in FIGS. 7 and 8.

When the golf bag is lifted by a user or moved to stand upright on the ground, the raising plates 6,7 and the inner support part 8 will move back to the position shown in FIG. 4 due to the weight of the golf clubs.

From the above description, the golf bag of the present invention can be seen to have a desirable feature: the golf clubs received in the golf bags can be easily moved up and down by locating the golf bag in a sloping and an upright position respectively.

What is claimed is:

1. A golf bag capable of raising golf clubs, comprising a holding part for holding said golf clubs therein;

a bottom part having a front flat part and a rear slope part; said bottom part being connected to a lower end of said holding part; said bottom part having two holding tubes projecting into said holding part; said holding tubes each having a pair of opposing straight trenches and a guide slot lengthwise formed thereon;

said bottom part having two elongated openings thereon, each communicating with a respective one of said guide slots; said bottom part having two pairs of guide bars adjacent to said holding tubes, each of said pairs of guide bars forming a guide trench therebetween; two sliding members each movably received in a respective one of said holding tubes; said sliding members each having two protrusions fitted on said straight trenches of said holding tube; said sliding members each having a raising block passed through said guide slot of said holding tube, and movable through a respective one of said elongated openings; elastic members being located between said holding tubes and said sliding members; said sliding members having lower ends contacting said first raising plate;

a second raising plate movably arranged above said bottom part; said second raising plate having two holes provided for said holding tubes to be passed through; said second raising plate having two gaps; said two pairs of guide bars being each passed through a respective one of said gaps of said second raising plate; said second raising plate having a guide protrusion in each of said gaps; said guide protrusions being each fitted onto a respective one of said guide trenches for confining a movement of said second raising plate; said second raising plate having a bottom resting on said raising blocks of said sliding members;

an inner support part received in said holding part and resting on said second raising plate, provided for holding said golf clubs thereon; whereby said golf clubs are capable of being raised by locating said golf bag in a sloping position where said rear slope part of said bottom part rests on said first raising plate with said first raising plate forcing said sliding members to move upwards to raise said second raising plate and said inner support part.

* * * * *